US011389043B2

(12) United States Patent
Haegermarck et al.

(10) Patent No.: US 11,389,043 B2
(45) Date of Patent: Jul. 19, 2022

(54) DISHWASHER SPRAY ARM ASSEMBLY

(71) Applicant: ELECTROLUX APPLIANCES AKTIEBOLAG, Stockholm (SE)

(72) Inventors: Anders Haegermarck, Trångsund (SE); Marie Hakkarainen, Stockholm (SE)

(73) Assignee: Electrolux Appliances Aktiebolag

( * ) Notice: Subject to any disclaimer, the term of this patent is extended or adjusted under 35 U.S.C. 154(b) by 0 days.

(21) Appl. No.: 16/759,903

(22) PCT Filed: Oct. 31, 2017

(86) PCT No.: PCT/EP2017/077876
§ 371 (c)(1),
(2) Date: Apr. 28, 2020

(87) PCT Pub. No.: WO2019/086108
PCT Pub. Date: May 9, 2019

(65) Prior Publication Data

US 2021/0177235 A1 Jun. 17, 2021

(51) Int. Cl.
*A47L 15/23* (2006.01)
*A47L 15/50* (2006.01)

(52) U.S. Cl.
CPC ..... *A47L 15/23* (2013.01); *A47L 15/50* (2013.01); *A47L 15/508* (2013.01)

(58) Field of Classification Search
None
See application file for complete search history.

(56) References Cited

U.S. PATENT DOCUMENTS

| | | | |
|---|---|---|---|
| 1,408,077 | A | 2/1922 | Clinton |
| 3,771,725 | A | 11/1973 | Jenkins et al. |
| 4,064,887 | A | 12/1977 | Geiger et al. |
| 4,869,428 | A | 9/1989 | Gombar |
| 5,477,874 | A | 12/1995 | Yura et al. |
| 5,542,443 | A | 8/1996 | Yura et al. |
| 5,598,976 | A | 2/1997 | Jang et al. |
| 5,673,174 | A | 9/1997 | Hamirani |

(Continued)

FOREIGN PATENT DOCUMENTS

| | | | |
|---|---|---|---|
| CN | 102905602 | A | 1/2013 |
| EP | 2 389 851 | A1 | 11/2011 |

(Continued)

OTHER PUBLICATIONS

International Search Report and Written Opinion for Application No. PCT/EP2017/077876 dated Jan. 15, 2018, 11 pages.

(Continued)

*Primary Examiner* — Levon J Shahinian
(74) *Attorney, Agent, or Firm* — RatnerPrestia

(57) ABSTRACT

A spray assembly may include a water supply conduit, a main spray arm, and a satellite spray arm. The main spray arm may be rotatably coupled to the water supply conduit to rotate about a first axis, and a satellite spray arm may be rotatably coupled to the main spray arm to rotate about a second axis. The satellite may define at least one nozzle and at least one fluid channel extending from the second axis to the at least one nozzle. The at least one fluid channel of the satellite spray arm may define an arcuate shape having a portion proximate the second axis disposed at a first distance relative to the base parallel to the second axis, and the at least one nozzle being disposed a second distance relative to the base parallel to the second axis. The second distance may be shorter than the first distance.

14 Claims, 10 Drawing Sheets

(56) References Cited

U.S. PATENT DOCUMENTS

| | | | | |
|---|---|---|---|---|
| 6,263,888 | B1 * | 7/2001 | Nomura | A47L 15/46 134/57 D |
| D461,284 | S | 8/2002 | Hegeman et al. | |
| 7,237,563 | B2 | 7/2007 | Han et al. | |
| 8,287,660 | B2 | 10/2012 | Chen et al. | |
| 8,333,207 | B2 | 12/2012 | Calhoun et al. | |
| 8,377,226 | B2 | 2/2013 | Favaro et al. | |
| 8,858,729 | B2 | 10/2014 | Buddharaju et al. | |
| 8,985,126 | B2 | 3/2015 | Forster et al. | |
| 2016/0192818 | A1 | 7/2016 | Gursoy et al. | |
| 2017/0265713 | A1 | 9/2017 | Kopyrin et al. | |

FOREIGN PATENT DOCUMENTS

| | | | |
|---|---|---|---|
| EP | 2 494 906 | A1 | 9/2012 |
| EP | 2 494 906 | B1 | 2/2013 |
| EP | 2 679 134 | A1 | 1/2014 |
| EP | 1 767 134 | B1 | 11/2014 |
| EP | 3 085 293 | A1 | 10/2016 |
| GB | 550 511 | A | 1/1943 |
| JP | 3 030908 | B2 | 4/2000 |
| WO | WO 2011/147716 | A1 | 12/2011 |

OTHER PUBLICATIONS

Nomura, H et al., *Non-Linear Technologies in a Dishwasher,* Fuzzy Systems, International Joint Conference on the Fourth IEEE International Conference on Fuzzy Systems and the Second International L Fuzzy Engineering Symposium, Proceedings of 1995 IEEE International Conference on Yokohama, Japan, vol. 5 (Mar. 20, 1995) 57-58.

* cited by examiner

DISHWASHER SPRAY ARM ASSEMBLY

CROSS-REFERENCE TO RELATED APPLICATIONS

This application is a national stage application filed under 35 U.S.C. § 371 of International Application No. PCT/EP2017/077876 filed Oct. 31, 2017, which application is hereby incorporated by reference in its entirety.

BACKGROUND

Field of the Invention

The present invention generally relates to appliances, such as dishwashers, that have rotating spray arms including spray nozzles. In particular, the present invention relates to a satellite spray arm for a dishwasher having a compact form factor.

Description of Related Art

Today's dishwashers are expected to perform high quality wash of dishware while being efficient in their use of energy and water during operation. A dishwasher usually comprises a washing chamber in which an upper rack, a middle rack, and/or a lower rack for accommodating items to be washed are arranged. In some modern dishwashers it is possible to adjust one or more of the racks in height to adapt the rack to different sizes of dishes. Further, a dishwasher usually comprises an upper spray arm, a middle spray arm, and/or a lower spray arm. The upper spray arm may be attached to an upper rack, the middle spray arm may be attached to the middle rack, and the lower spray arm may be attached to a lower rack. If a spray arm is attached to a height adjustable rack, the relationship between spray nozzles located on the spray arm and other elements within the dishwasher (e.g., the corners of the rack, the detergent dispenser, and/or the like) will change when the height of rack is changed.

A primary desirable characteristic of a dishwasher is the volume of dishes, cutlery, or the like that can be washed simultaneously such that the interior volume of a dishwasher includes valuable space that must be used efficiently for maximum capacity. However, an increased volume of articles to be washed poses a challenge for thoroughly and efficiently washing each article as articles within the dishwasher may compromise and block spray patterns within the dishwasher that are necessary to thoroughly wash the articles. Thus, there is a need to develop features that enhance the washing efficiency of a dishwasher while minimizing intrusion into areas configured to receive articles to be washed.

BRIEF SUMMARY

Embodiments of the present invention address the above by providing a spray arm assembly having a vertically compact form factor. Example embodiments of such a spray arm assembly may include a water supply conduit, a main spray arm, and a satellite spray arm. The main spray arm may be rotatably coupled to the water supply conduit, where the main spray arm is configured to rotate about a first, substantially vertical axis. The satellite spray arm is rotatably coupled to the main spray arm, where the satellite spray arm is configured to rotate about a second axis that is spaced from the first axis. The satellite spray arm may define at least one nozzle and at least one fluid channel extending from the second axis to the at least one nozzle. The at least one fluid channel of the satellite spray arm may define an arcuate shape having a first elevation relative to the main spray arm proximate the second axis and a second, lower elevation relative to the main spray arm proximate the at least one nozzle.

Embodiments of the spray arm assembly may include a satellite spray arm that defines at least two nozzles disposed on opposite sides of the second axis and configured to direct spray away from the main spray arm. The at least one channel of the satellite spray arm may define a figure-eight, where a center of the figure eight is disposed at the second axis, and the at least two nozzles are disposed on opposite extremities of the figure eight. The second axis may be angled relative to the first axis between about two degrees and about eight degrees, and may be angled at four degrees relative to the substantially vertical first axis.

According to some embodiments, the at least one nozzle of the satellite spray arm is positioned below a fluid inlet to the satellite spray arm during at least a portion of a rotation of the at least one nozzle about the second axis. The main spray arm may include a first portion and a second portion, where the first portion is disposed on a first side of the first axis, and the second portion is disposed on a second side of the first axis, opposite the first. The first portion of the main spray arm may define a thickness, where the second portion of the main spray arm defines a second thickness, less than the first thickness, and where the satellite spray arm is coupled to the second portion.

The main spray arm of some example embodiments may include at least one nozzle configured to direct fluid in a direction that causes rotation of the main spray arm about the first axis, and where the satellite spray arm includes at least one nozzle configured to direct fluid in a direction that causes rotation of the satellite spray arm about the second axis. The satellite spray arm may include an outer ring forming a circle in a plane perpendicular to the axis. The satellite spray arm may include a main body having a first thickness proximate the second axis, and a second, smaller thickness proximate the outer ring, where the thickness tapers from the first thickness to the second thickness.

According to some embodiments, the main spray arm may include a hub into which a neck of the satellite spray arm is received, where the fluid is transmitted from the main spray arm to the satellite spray arm through the hub and the neck. The spray arm assembly may be suspended from a wash rack of a dishwasher through an attachment between the water conduit supply and the wash rack. The satellite spray arm may define a fluid inlet, where each of the at least one nozzles includes a pair of separate fluid passageways leading from the fluid inlet to the respective nozzle. The satellite spray arm may include an outer ring forming a circle about the second axis, where at least one aperture may be defined through the satellite spray arm within the outer ring.

BRIEF DESCRIPTION OF THE SEVERAL VIEWS OF THE DRAWINGS

Figure 1:
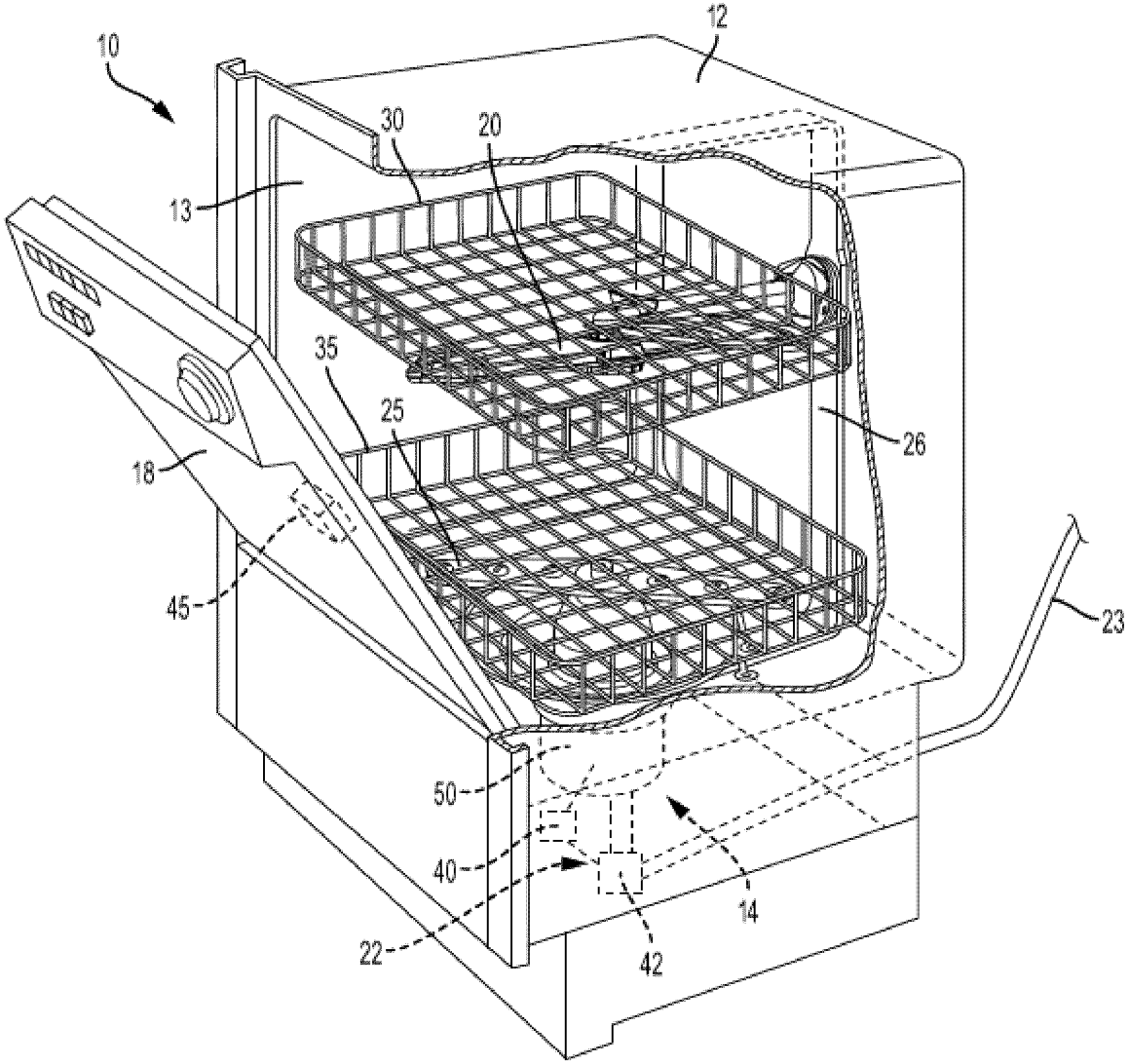
Figure 2:
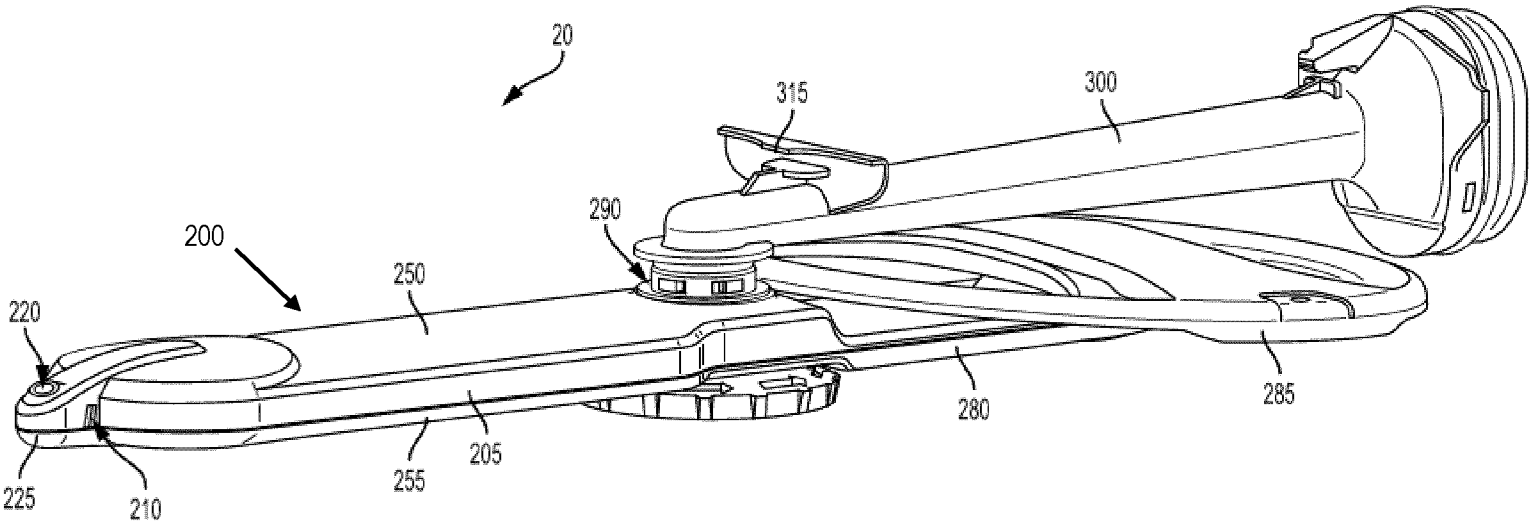
Figure 3:
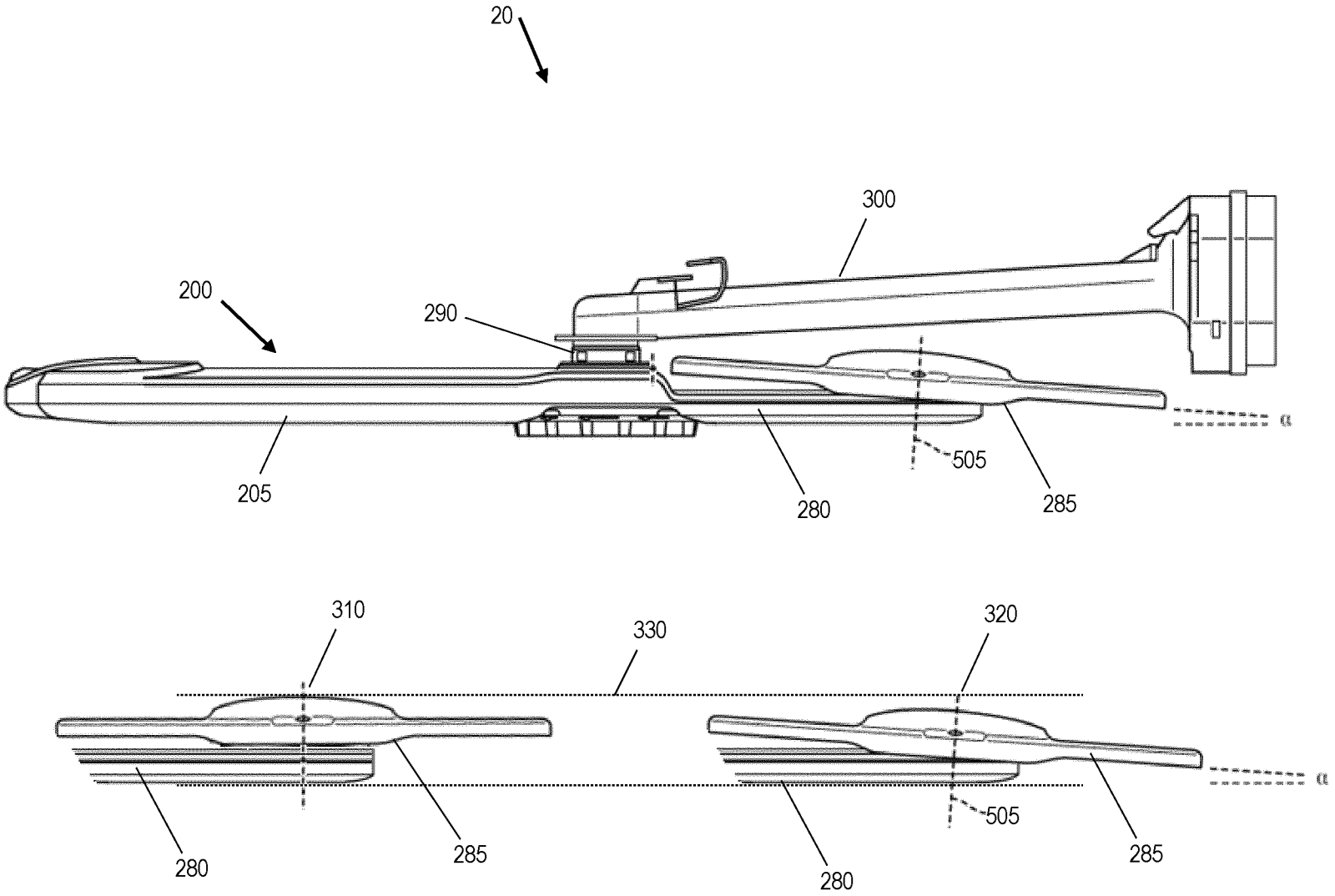
Figure 4:
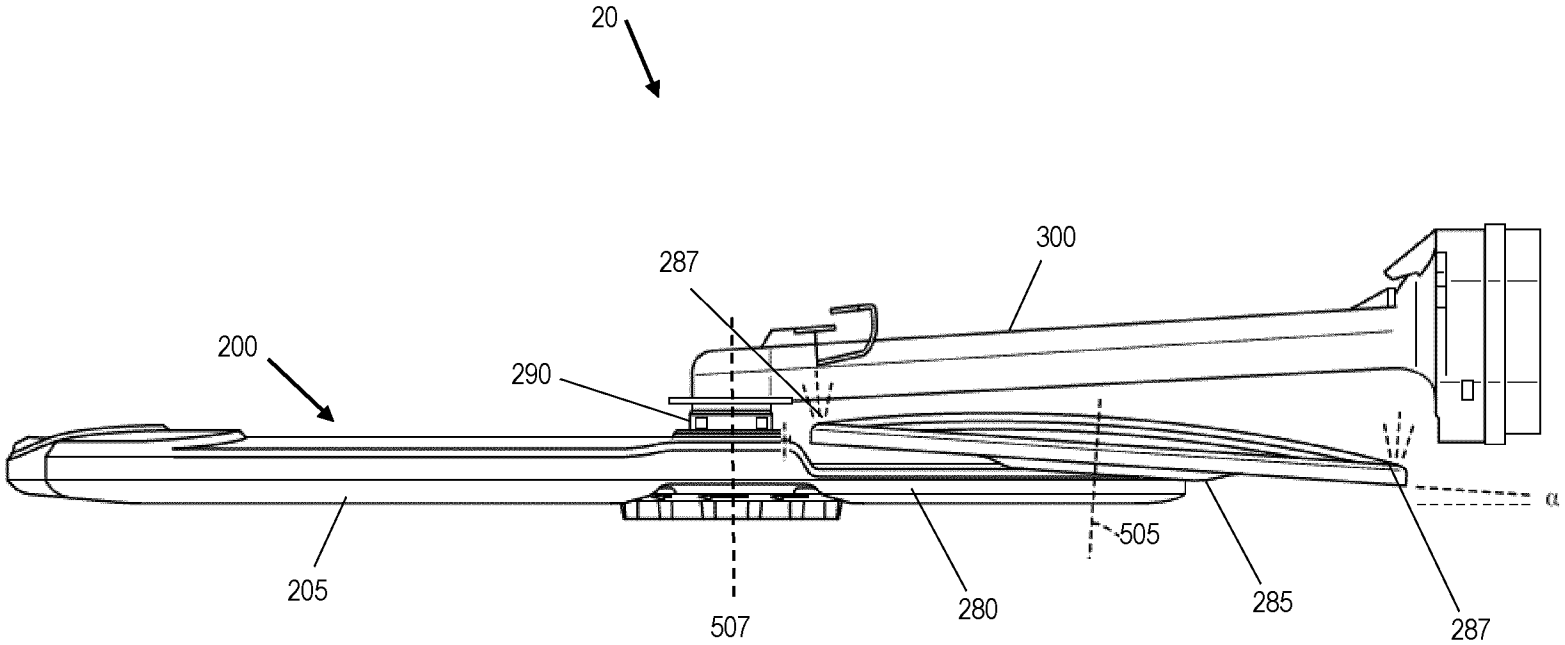
Figure 5:
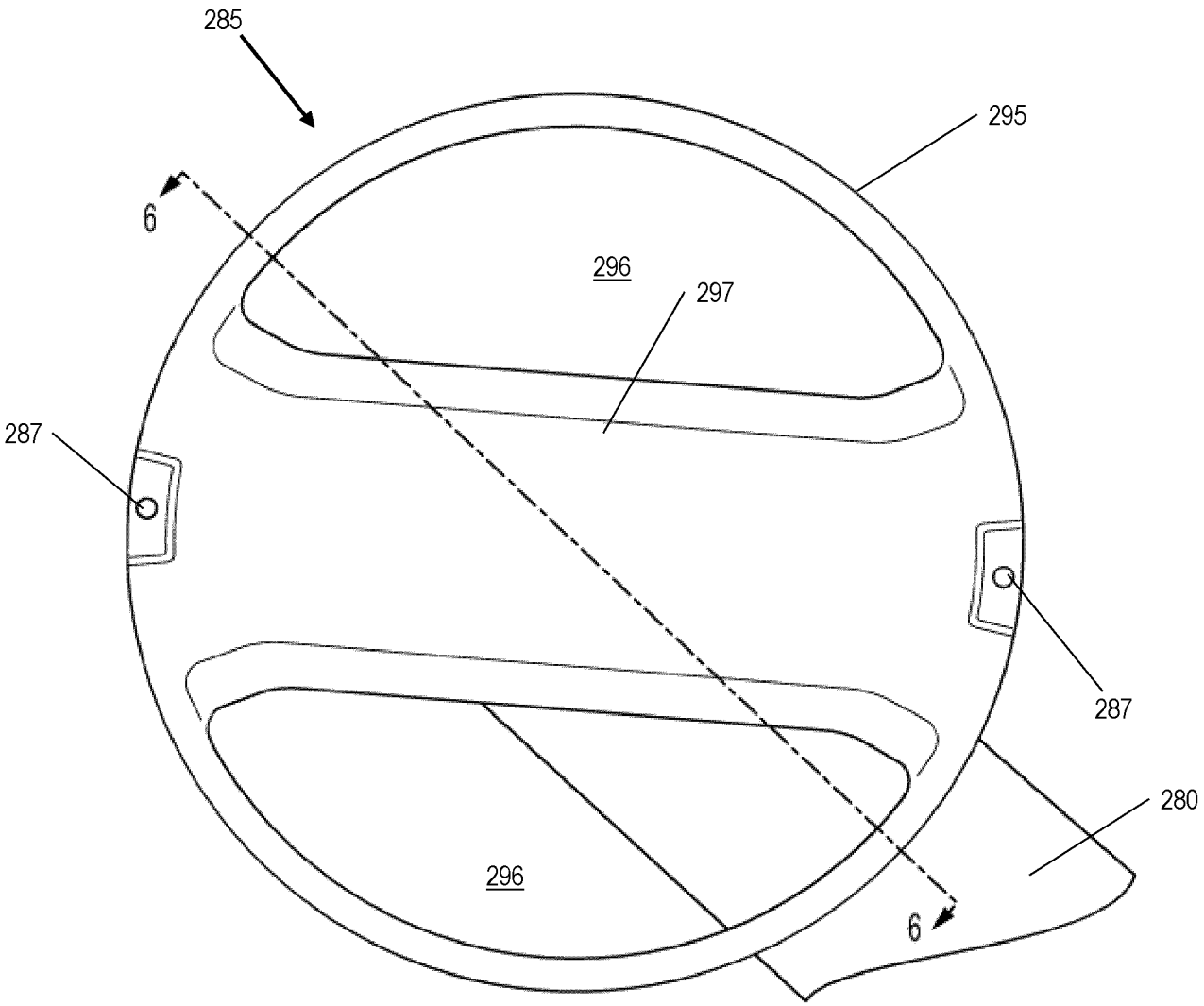
Figure 6:
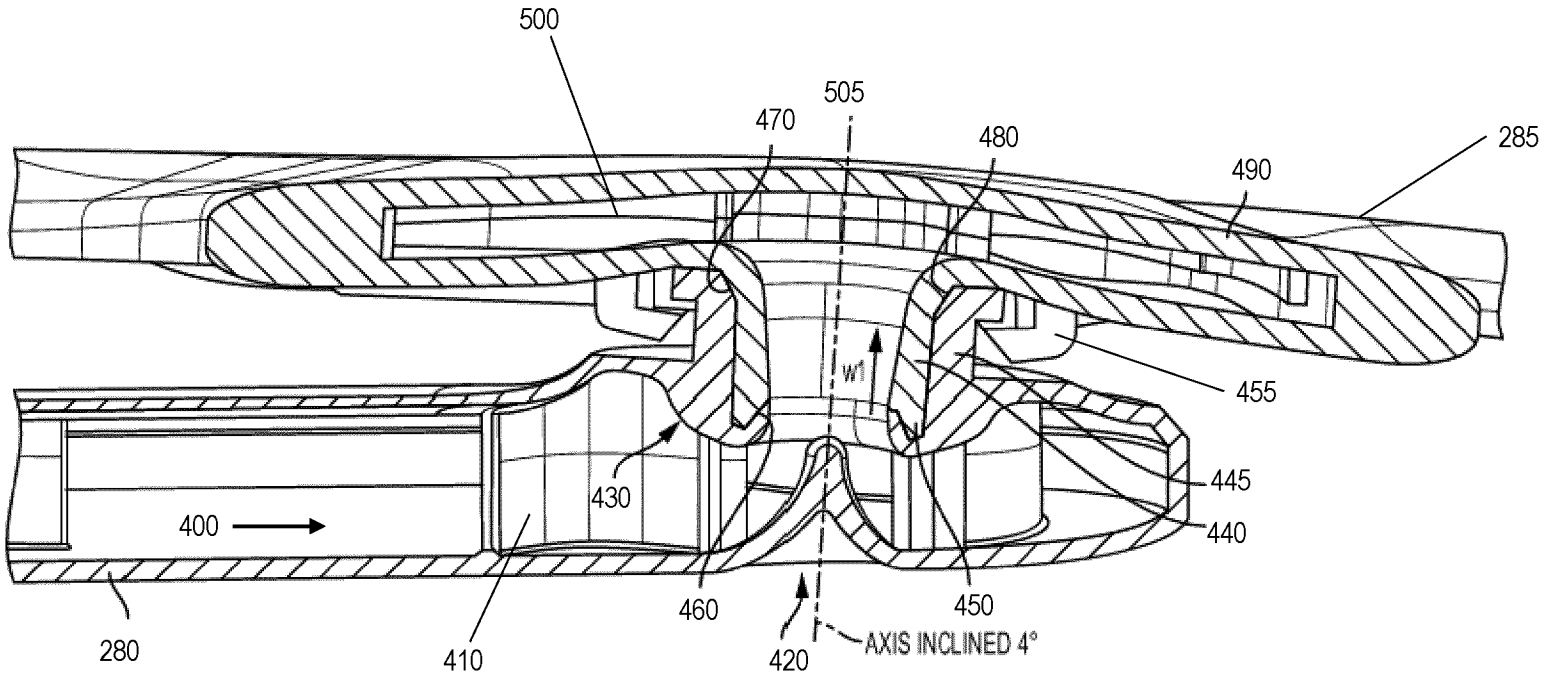
Figure 7:
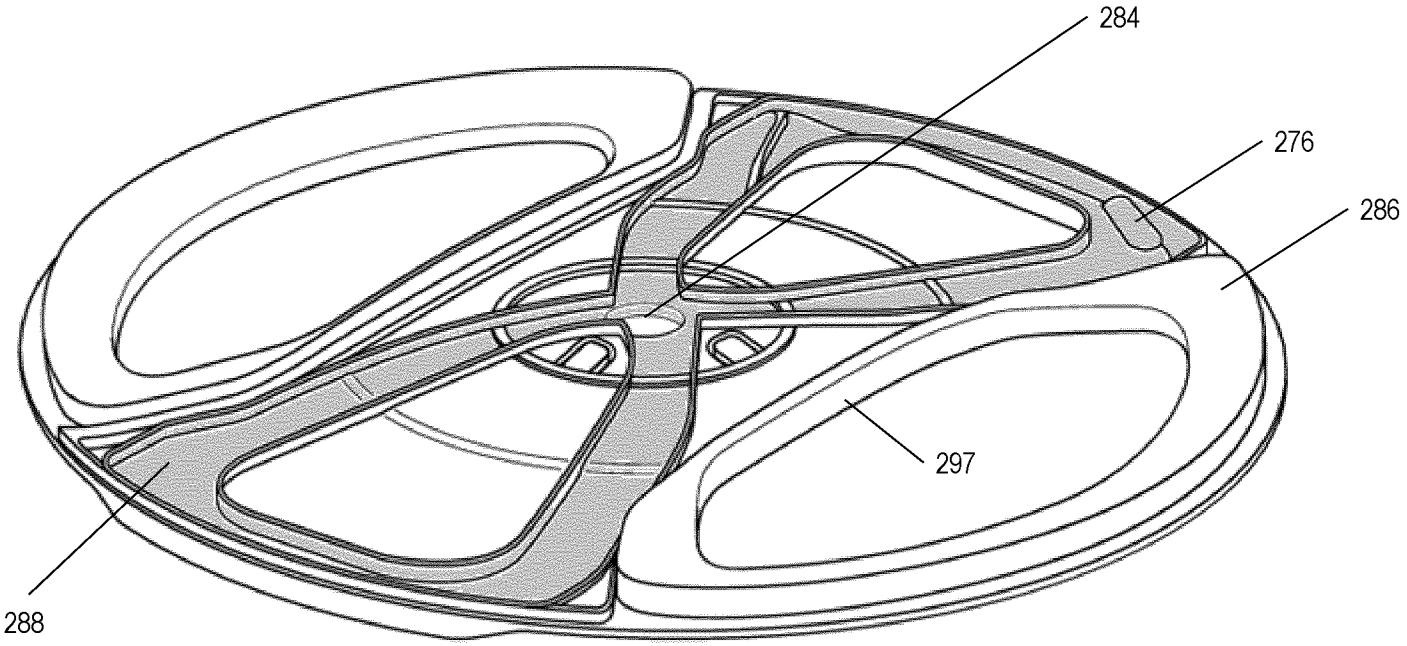
Figure 8:
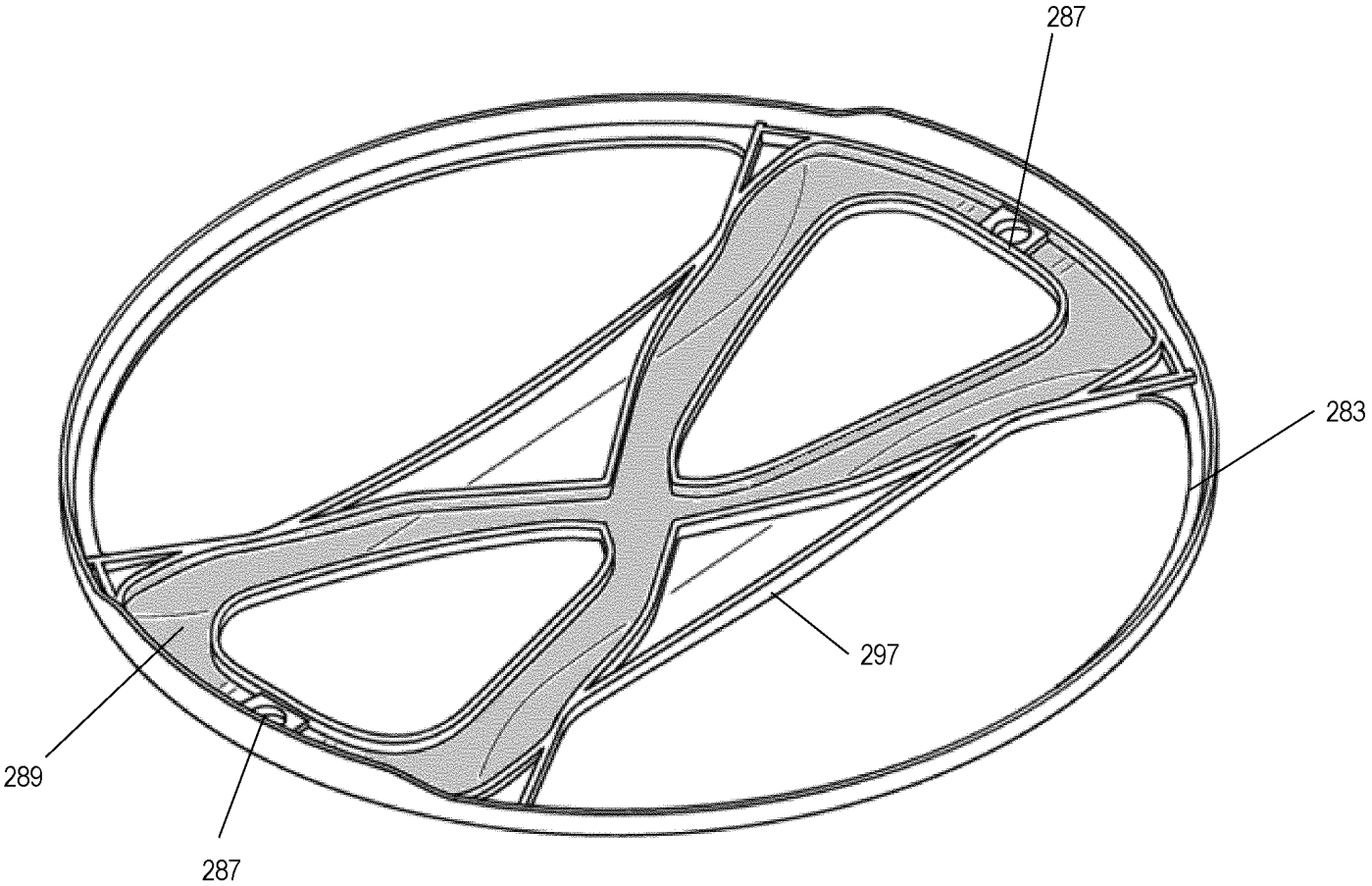
Figure 9:
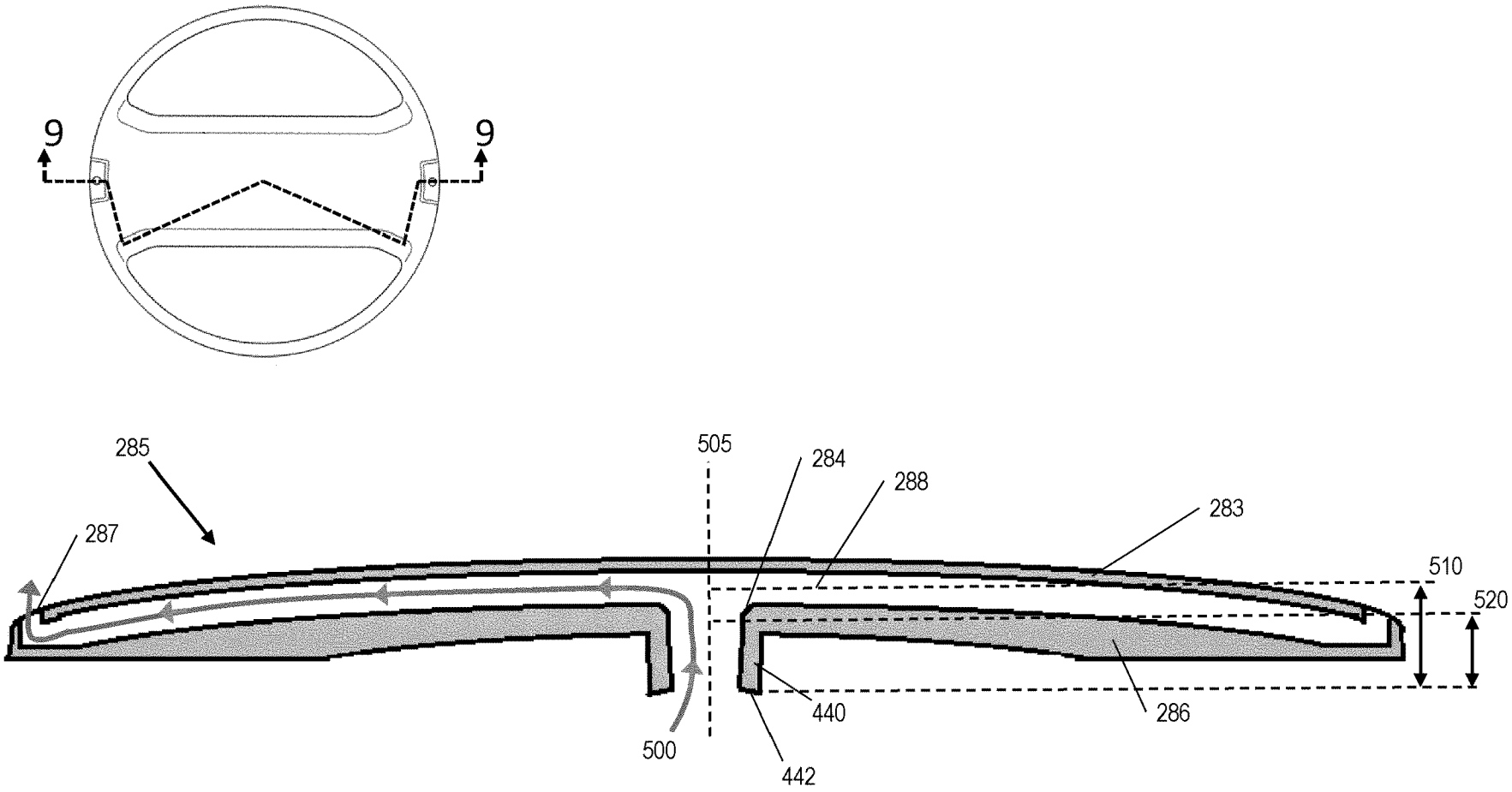
Figure 10:
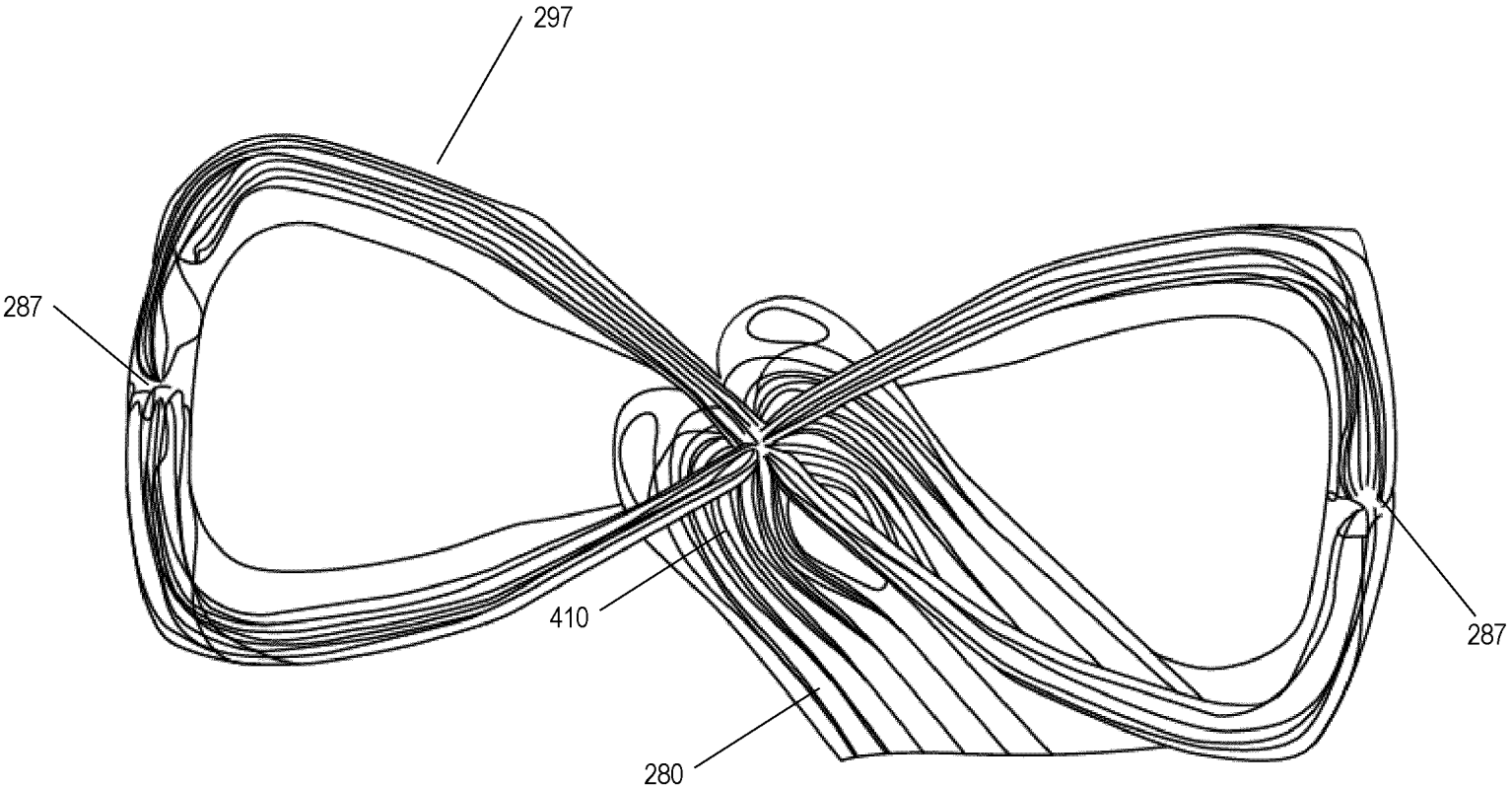

Having thus described embodiments of invention in general terms, reference will now be made to the accompanying drawings, which are not necessarily drawn to scale, and wherein:

FIG. 1 is a perspective view of a dishwasher of a type suitable for use with various embodiments of the present invention;

FIG. 2 is a perspective view of a spray arm assembly including a main spray arm and a satellite spray arm according to an example embodiment of the present invention;

FIG. 3 is a side profile view of a spray arm assembly having a vertically compact form factor according to an example embodiment of the present invention;

FIG. 4 is another side profile view of a spray arm assembly having a vertically compact form factor according to an example embodiment of the present invention;

FIG. 5 is a top plan view of a satellite spray arm according to an example embodiment of the present invention;

FIG. 6 is a section view of a satellite spray arm along the section line 6-6 of FIG. 5 according to an example embodiment of the present invention;

FIG. 7 depicts a bottom portion of a satellite spray arm separated from a top part according to an example embodiment of the present invention;

FIG. 8 depicts the top portion of a satellite spray arm separated from the bottom part according to an example embodiment of the present invention;

FIG. 9 illustrates a section view of a satellite spray arm according to an example embodiment of the present invention; and FIG. 10 depicts a flow diagram of fluid flow through a main spray arm and through the satellite spray arm according to an example embodiment of the present invention.

DETAILED DESCRIPTION OF SOME EXAMPLE EMBODIMENTS

The present invention now will be described more fully hereinafter with reference to the accompanying drawings, in which some, but not all embodiments of the invention or inventions are shown. Indeed, these inventions may be embodied in many different forms and should not be construed as limited to the embodiments set forth herein; rather, these embodiments are provided so that this disclosure will satisfy applicable legal requirements. The term "or" (also designated as"/") is used herein in both the alternative and conjunctive sense, unless otherwise indicated. The terms "illustrative" and "exemplary" are used to be examples with no indication of quality level. As used herein, the terms "approximately" and "generally" refer to within manufacturing and/or engineering tolerances for the corresponding materials and/or elements, unless otherwise indicated. Like numbers refer to like elements throughout.

Overview of an Example Dishwasher

FIG. 1 illustrates one example of a dishwasher 10 capable of implementing various embodiments of the present invention. Such a dishwasher 10 typically includes a tub 12 (partly cut away in FIG. 1 to show internal details), having a plurality of walls (e.g., side wall 13) for forming an enclosure or washing chamber in which dishes, utensils, and other dishware may be placed for washing. A door 18 may be pivotably engaged (e.g., about a hinge) with the tub 12 to selectively permit access to the interior of the tub 12. For example, the door 18 may comprise an open configuration and a closed configuration, such that the door 18 may at least substantially seal the forward access opening of the tub 12 in the closed configuration.

The door 18 may comprise an inner surface that acts as a wall of the tub 12 when the door 18 is in the closed position. A detergent dispenser 45 may be disposed on and/or embedded in the inner surface of the door 18. A user of the dishwasher 10 may provide detergent into the detergent dispenser 45 before starting a dishwashing program such that the detergent may be provided to the wash water within tub during a pre-wash and/or wash cycle of the dishwashing program. In an example embodiment, the detergent dispenser 45 comprises a hinged door that the user closes before starting the dishwashing program and that is electromechanically opened during a wash cycle of the dishwashing program by a controller 40, and/or the like.

The tub 12 may include a sump 14 in which wash water or rinse water is collected, typically under the influence of gravity. The wash/rinse water may be pumped by a circulation pump 50 to one or more spray arms (e.g., lower spray arm 25, middle spray arm 20) mounted in the interior of the tub 12 (e.g., mounted to a lower or middle rack which is not shown or mounted to a wall 13 of the tub 12) for spraying the wash/rinse water, under pressure, onto the dishes, utensils, and other dishware contained therein. For example, the circulation pump 50 may be configured to pump wash water through a circulation hose 26 to the middle spray arm 20 for spraying into the tub 12, such as through one or more spray nozzles located on the middle spray arm 20. The dishwasher may also include an upper spray arm (not shown) disposed proximate the top of the tub 12 and configured to spray downwardly towards an upper rack and/or the middle rack.

The dishwasher 10 may also include a controller 40 that may be in communication with one or more of the operational components of the dishwasher 10. For example, the controller 40 may be in communication with the circulation pump 50 and may be configured to selectively operate the circulation pump 50 to pump wash water to at least one spray arm and/or spray nozzle. In some embodiments, the controller 40 may be in communication with the detergent dispenser to release the detergent at a predetermined time during a dishwasher program cycle. In another example, the controller 40 may be in communication with the water inflow system (not shown) configured to provide water to the dishwasher 10. In various embodiments, the controller 40 may be in communication with a drain pump 42 configured to pump wash fluid out of the dishwasher 10 via drain pipe 23. In some embodiments, the controller 40 may comprise a processor and/or other computing means such that operations can be performed in the dishwasher. Additionally or alternatively, the controller 40 may comprise a memory (e.g., volatile memory and/or nonvolatile memory) for storage of data and/or executable instructions such as routines for operation of the dishwasher. In some embodiments, the controller 40 may further comprise a communications interface for communicating with various elements of the dishwasher 10 (e.g., circulation pump 50, a door sensor, user interface sensor, and/or the like) or for communicating with one or more computing devices via a wired or wireless network (e.g., the Internet, a local Wi-Fi network, and/or the like). In some embodiments, the controller 40 may comprise a mechanical timer in addition to or in place of a processor. In some embodiments, the controller 40 may be housed in the lower end 22 of the dishwasher 10 beneath the tub 12.

The dishwasher 10 may also include at least one dish rack 30, 35 for holding the dishes, utensils, dishware, or other articles to be washed. The dish rack 30, 35 can be positioned within the tub 12 to hold dishware for cleaning, such as through wash water that is sprayed onto the dishware from the spray arms and/or spray nozzles. For example, in one example embodiment, middle spray arm 20 may be secured to the underside of an upper or middle rack 30 configured for holding dishes, utensils, and/or dishware. In various embodiments, one or more of the dish racks 30, 35 may be height adjustable. For example, the middle rack 30 may be adjustable between a first position and a second position, such that when the middle rack 30 is in the first position, the distance between the middle rack 30 and the lower rack 35 is a greater distance than when the middle rack 30 is in the second position.

In an example embodiment, the middle spray arm 20 may be coupled to a fluid conduit 300 (see FIG. 2). For example, the middle spray arm 20 may be rotatably coupled and/or attached to the fluid conduit 300. In some embodiments, the fluid conduit 300 is coupled and/or attached to a corresponding dish rack 30. For example, in an example embodiment, the fluid conduit 300 may be coupled to a height adjustable dish rack 30 and may move when the dish rack 30 is adjusted between a first position and/or height and a second position and/or height. In an example embodiment, the fluid conduit comprises a flexible coupling on an end of the fluid conduit that is opposite the spray arm 20 that is configured to engage the water circulation hose 26 at various heights and/or positions. For example, the fluid conduit 300 comprises a flexible coupling configured to engage the water circulation hose 26 when the height adjustable dish rack 30 is in the first position and/or height and when the height adjustable dish rack 30 is in the second position and/or height.

Embodiments described herein generally relate to a spray arm assembly that includes a main spray arm and a satellite spray arm coupled there to. While the configuration described herein may be used in the position of any spray arm within a dishwasher (e.g., top, middle, bottom, etc.), embodiments described herein will generally refer to a spray arm disposed in the middle of the dishwasher relative to the height of the tub, configured to spray primarily upwardly toward articles to be washed on a rack above the spray arm. As illustrated in FIG. 1, the spray arm 20 is positioned as a middle spray arm disposed beneath the dish rack 30 and above dish rack 35. As the spray arm 20 is disposed within the tub 13 at a position proximate to where dishes and articles to be washed will be loaded, it is desirable that the spray arm 20 be configured in a vertically compact form factor, while still being able to perform the function of spraying the articles to be washed effectively. While a compact form factor may be readily achieved when using a single spray arm, a single spray arm may not be as effective as a spray arm assembly that includes both a main spray arm and a satellite spray arm. The benefit of including a main spray arm and a satellite spray arm may include that a broader spray pattern may be achieved by the spray arm assembly, and the angle of impingement of water from the spray arm assembly may be varied by the satellite spray arm in a manner that is not achieved using only a single spray arm. However, a spray arm assembly including a main spray arm and a satellite spray arm necessitates greater complexity of assembly than a single spray arm, and typically occupies considerably more space, particularly in the vertical direction, than a single spray arm. Provided herein is a spray arm assembly that achieves benefits of a spray arm assembly including a main spray arm and a satellite spray arm, and further does so in a vertically compact form factor with an arrangement that improves the efficiency of washing the contents of the tub of the dishwasher.

Exemplary Spray Arm

Example embodiments provide a spray arm assembly as shown in FIG. 2, for example an assembly for a middle spray arm 20, having a satellite spray arm 285. In an example embodiment, the spray arm assembly may be a bottom spray arm (e.g., coupled to an bottom dish rack or the bottom of the tub), middle spray arm (e.g., coupled to a middle dish rack), a spray arm located above the lower rack (e.g., coupled to an upper or middle dish rack), and/or the like. FIG. 2 provides a perspective view of an example spray arm assembly 20 having a main spray arm 200 and a satellite spray arm 285. Fluid is supplied to the spray arm assembly 20 via water conduit 300. The water conduit 300 is configured to receive washing liquid (e.g., wash and/or rinse water) from the water circulation hose 26 and provide the washing liquid to the spray arm assembly 20. For example, when the circulation pump 50 is operated, the circulation pump 50 may pump the washing liquid through the water circulation hose 26 to the water conduit 300. In the depicted embodiment, the spray arm assembly 20 is rotatably mounted on, coupled to, attached to, and/or the like the water conduit 300 and the water conduit may be mounted to a dish rack 30, which may be height adjustable, via a mounting element 315. In an example embodiment, the spray arm assembly 20 is mounted to a wall 13 of the tub 12 in a height adjustable manner (e.g., via the water conduit 300).

In the embodiment shown in FIG. 2, the spray arm assembly 20 is mounted to the water conduit 300 at mounting point 290. Generally, mounting point 290 is configured to conduct water from the water conduit to one or more water channels within the main spray arm 200. Generally, the main spray arm 200 is configured to rotate about the mounting point 290. In an example embodiment, the main spray arm 200 comprises a driving side 205 and a satellite spray arm 285 mounted to a satellite side 280 of the main spray arm 200. In an example embodiment, the satellite spray arm 285 may comprise a plurality of nozzles configures to spray jets of washing liquid onto dishes, utensils, and/or dishware within the dishwasher. For example, the satellite spray arm 285 may be similar to the second spray arm described in Intl. Appl. No. PCT/EP2016/066289, filed Jul. 8, 2016, the contents of which are hereby incorporated by reference. The driving side 205 and satellite side 280 of the main spray arm 200 may share a common axis along the length of main spray arm 200. However, the driving side 205 and the satellite side 280 extend in generally opposite directions from central rotation axis through the mounting point 290.

The driving side 205 of the main spray arm 200 may optionally include one or more nozzles configured to spray washing fluid onto the contents of the dish rack to which the spray arm assembly is mounted at 315 and/or spray washing fluid onto the contents of a rack disposed below the spray arm assembly 20. However, the driving side 205 of the main spray arm 200 may also include a driving nozzle 210 that emits a spray of washing fluid in a manner that causes a reactive force on the main spray arm 200 to rotate the main spray arm 200 about the mounting point 290. The driving nozzle 210 may function as both a spray nozzle for directing wash fluid onto articles to be cleaned while simultaneously providing the force necessary to cause rotation of the main spray arm 200. The wash fluid may exit the driving nozzle 210 in any of a variety of spray patters, such as a fan spray pattern, a jet spray (e.g., a single, focused stream), a broad, circular spray pattern, or the like. However, the general angle at which the wash fluid exits the driving nozzle may be in a direction that causes rotation of the main spray arm 200. The general direction or angle of exit of the wash fluid from the driving nozzle 210 may be configured to effect a specific rotational speed of the main spray arm 200 when the pump is operating in a washing or rinsing mode, and the size of the nozzle may be configured to result in such a rotational speed. The driving nozzle may be adjustable or replaceable in order to accommodate different angles or flow rates in order to achieve an ideal rotational speed of the main spray arm 200 in different settings or scenarios, such as if a dishwasher pump is designed to use less water with lower flow, the pressure may be increased through a narrower nozzle outlet to compensate for the lower flow.

FIG. 3 illustrates a side-view of the wash arm assembly 20 of FIG. 2 including the water conduit 300, main wash arm 200 having the driving side 205 and the satellite side 280, upon which satellite spray arm 285 is mounted. As shown, the driving side of the main wash arm is of a first thickness in the vertical direction of the dishwasher. While a conventional spray arm may have a total length extending on both sides of the mounting point 290 with a uniform thickness, embodiments described herein include a spray arm assembly 20 having a compact form factor in the vertical direction (e.g., along or parallel to the axis of rotation of the main spray arm 200 through mounting point 290) to maximize the available area within the tub of the dishwasher to accommodate articles to be washed, such as dishes. In order to accommodate the satellite arm 285 within a vertically compact form factor, the satellite portion 280 of the main spray arm 200 is of a second thickness, less than the first thickness of the driving portion 205 of the main spray arm 200.

As shown in FIG. 3, the satellite spray arm 285 is mounted to the satellite portion 280 of the main spray arm 200. The method of attachment will be described further below; however, the attachment allows the satellite spray arm 285 to rotate relative to the main spray arm 200 about an axis, shown as Axis 505 in FIG. 3, while allowing fluid flow from the water supply 300, through the mounting point 290 into the main spray arm 200, through the satellite portion 280 of the main spray arm, and into the satellite spray arm 285. While the axis of rotation 505 of the satellite spray arm may be vertical and parallel to the axis of rotation of the main spray arm 200 through mounting point 290, imparting an angle between the axis of rotation 505 and the vertical enables a yet more compact vertical form factor for the spray arm assembly 20. The angle $\alpha$ allows a lower relative mounting point between the satellite spray arm and the satellite portion 280 of the main spray arm 200. The angle by which the axis 505 is offset relative to the vertical may be configured according to the size and configuration of the dishwasher, but may be between about two degrees and about eight degrees, or in the illustrated configuration at about four degrees. FIG. 3 illustrates the space-saving configuration of implementing an axis of rotation that is angled relative to a vertical axis of rotation. As shown, a satellite arm using a vertical axis of rotation 310 requires clearance so the satellite spray arm 285 does not interfere with the satellite portion 280 of the main spray arm, while an angled axis of rotation 320 allows the satellite spray arm 285 to be mounted lower on the satellite portion 280 of the main spray arm, resulting in a reduced overall height demonstrated by line 330.

FIG. 4 illustrates the side-view of the wash arm assembly 20 as shown in FIG. 3; however, the satellite spray arm 285 is rotated 90-degrees relative to the satellite spray arm 285 of FIG. 3. As shown, the satellite spray arm 285 includes nozzles 287 disposed on opposite sides of the satellite spray arm 285 relative to the axis of rotation 505. The nozzles 287 are depicted as spraying substantially upwardly relative to the satellite spray arm 285. The angle of the axis of rotation 505 of the satellite spray arm has additional benefits beyond contributing to the vertically compact form factor described above. The angle of the axis of rotation 505 also promotes a wider spray pattern from the satellite spray arm 285 by angling the nozzles 287 relative to the axis of rotation of the main spray arm through mounting point 290 illustrated by vertical axis 507. Also illustrated in FIG. 4 is the arcuate shape of the satellite spray arm 285 between the nozzles 287. This configuration, as described further below, further contributes to the vertically compact form factor of the spray arm assembly 20.

FIG. 5 illustrates a top-view of the satellite spray arm 285 including an outer ring 295, a main body 297, and nozzles 287 disposed on opposite ends of the satellite spray arm 285. The satellite spray arm is configured to rotate about a center of the circular shape relative to the satellite portion 280 of the main spray arm. According to the illustrated embodiment, within the outer ring 295 are defined two apertures 296 through the satellite spray arm. These apertures reduce the weight of the satellite spray arm, while enabling the outer ring 295 to be maintained. This circular outer ring 295 defines a path of the satellite spray arm during rotation. Absent this outer ring 295, articles positioned within the dishwasher for cleaning may obstruct the rotation of the satellite spray arm. Providing a continuous outer ring 295 defines and occupies the path of rotation of the satellite spray arm, reducing the likelihood of articles to be washed interfering with the rotation of the satellite spray arm.

FIG. 6 illustrates the section view taken along section line 6-6 of FIG. 5. As shown, the section line bisects the satellite portion 280 of the main spray arm. Wash fluid flows from the water conduit 300 through the mounting point 290 into the main spray arm 200. The main spray arm includes a fluid flow channel therein that supplies the driving nozzle 210 in the driving portion 205 of the main spray arm 200, and a fluid flow channel that supplies the satellite spray arm 285 through satellite portion 280. The fluid flows through the satellite portion 280 along the fluid flow channel along arrow 400 to cavity 410. Cavity 410 encircles a flow director 420 disposed in the middle of the cavity 410 such that fluid flows around the cavity 410 and is directed upward, along arrow w1 into the satellite spray arm 285. The satellite spray arm 285 is rotatably mounted to the satellite portion 280 of the main spray arm by a low-friction coupling where engagement is maintained between the satellite spray arm 285 and the satellite portion 280 of the main spray arm through the forces exerted by the water as it exits the nozzles 287 of the satellite spray arm. The low-friction coupling includes a hub 430 within the satellite portion 280 of the main spray arm into which a neck 440 of the satellite spray arm 285 is received. A ridge 450 of the neck 440 at the base of the neck is received into a channel 460 of the collar. A shoulder 470 of the hub 430 is engaged with a collar 480 of the satellite spray arm 480 in a manner that promotes a low-friction engagement while retaining the satellite spray arm 285 to the satellite portion 280 of the main spray arm. A flange 445 may be used to retain the satellite spray arm 285 to the satellite portion 280 during fluctuations in fluid flow, during transportation or when handling for example racks in the dishwasher with clips 455. A fluid flow chamber 500 within the satellite spray arm 285 is in fluid communication with the cavity 410 by way of the path through the neck 440 of the satellite spray arm.

The satellite spray arm 285 may, according to some embodiments, include two primary components. A top portion and a bottom portion. FIG. 7 illustrates a bottom portion 286 of a satellite spray arm 285 according to an example embodiment, where the orifice 284 through the neck of the satellite spray arm is depicted, through which wash fluid enters the satellite spray arm 285. As described above, the satellite spray arm 285 includes a wash fluid flow channel 288, a portion of which is formed in the bottom portion 286 of the satellite spray arm 285. As illustrated, the fluid flow channel generally forms a figure-eight within the main body 297 of the satellite spray arm. The fluid flow channel 288 of the illustrated embodiment is shaded for ease of understanding. As will be detailed below, the top portion of the satellite spray arm cooperates with the bottom part 286 to enclose the fluid flow channel 288 in the figure-eight shape. This enables wash fluid to enter the fluid flow channel 288 through the orifice 284 and fill the fluid flow channel. The fluid flow channel 288 figure-eight shape comprises four separate passageways emanating from the orifice 284, where two pairs of passageways each meet at a separate nozzle 287, disposed on opposing sides of the satellite spray arm 285.

FIG. 7 further illustrates a driving nozzle 276, the nozzle portion of which faces a direction substantially tangential to the circle formed by the satellite spray arm 285. The driving nozzle 276 may receive fluid from within the figure-eight fluid flow channel 288, and direct the fluid in a direction substantially tangential to the satellite spray arm 285 in order to provide dynamic force to the satellite spray arm to cause rotation thereof. The driving nozzle 276 may be an optional feature as the nozzles 287 may provide the motivating force for causing rotation of the satellite spray arm 285 by virtue of their angle of spray. For example, one or both of the nozzles 287 may be directed upward relative to the dishwasher, but may also be angled relative to the vertical axis. In an embodiment in which both nozzles 287 are angled relative to the vertical axis, their angle may be opposite relative to one another by virtue of their opposing locations on the satellite spray arm, thus cooperating to provide dynamic force to the satellite spray arm for rotation thereof.

FIG. 8 illustrates the top portion 283 of the satellite wash arm 285 including the fluid flow channel 289 that cooperates with the fluid flow channel 288 of the bottom portion 286 to enclose the fluid flow channel. Once enclosed, the fluid flow channel has a fluid entrance through orifice 284, and fluid exits through nozzles 287 disposed at opposite extremities of the figure-eight fluid flow channel 289. Wash fluid may optionally exit through driving nozzle 276 as described above. As with the driving nozzle 210 discussed above, the nozzles 287 and 276 of the satellite spray arm may be removable/replaceable and/or adjustable to suit different dishwasher configurations, operation conditions, or the like.

FIG. 9 illustrates the fluid flow channel formed by the top portion 283 and the bottom portion 286. The cross-section along which FIG. 9 is taken is shown by section line 9-9 of the top-view of the satellite spray arm. The section line follows a portion of the figure-eight channel so as to show the profile of the fluid flow channel 288. As shown, fluid enters the satellite spray arm along neck 440 from a base 442 of the neck represented by arrow 500. The fluid flows along arrow 500, along channel 288, and exits the spray arm through nozzle 287. While illustrated only by a single arrow of flow, it is understood that fluid flows through all portions (e.g., all four separate passageways) of the figure-eight channel 288 from the orifice in the neck 440 through to the two nozzles 287 on opposite sides of the satellite spray arm.

Importantly, FIG. 9 illustrates the arcuate nature of the fluid flow channel 288, where the fluid flow channel enters the channel at the channel's highest point relative to the body of the satellite spray arm, at a first distance 510 parallel to the second axis 505 relative to the base 442 of the neck 440, and descends along the arcuate fluid flow channel 288 to nozzles 287, disposed at a second distance 520 parallel to the second axis 505 relative to the base, where the second distance 520 is shorter than the first distance 510. This arcuate shape of the fluid flow channel facilitates the curved shape of the satellite spray arm to promote a vertically compact form factor for the spray arm assembly 20. The arcuate shape of the satellite spray arm, as shown in FIG. 4, allows the main spray arm 200 to be more closely coupled to the water supply 300, thereby shortening the overall height of the spray arm assembly 20, and increasing the available volume within the dishwasher for contents that are to be washed. As evident in FIG. 4, if the satellite spray arm 285 was a uniform thickness from the center to the extremities where the nozzles 287 are positioned, the satellite spray arm 285 would interfere with the water supply 300. The curved, arcuate shape to the satellite spray arm 285 enables close coupling between the satellite portion 280 of the main spray arm 200 in cooperation with the angled axis of rotation of the satellite spray arm 285, as detailed in FIG. 3.

The various features described herein cooperate to form a vertically compact form factor for a spray arm assembly 20. As described above, the short height of the satellite portion 280 of the main spray arm 200, the arcuate shape of the satellite spray arm 285, and the angled axis of rotation of the satellite spray arm each cooperate to allow the main spray arm to be close-coupled to the water supply 300, thereby shortening the overall height of the spray arm assembly 20.

FIG. 10 illustrates flow lines for fluid flow through the satellite spray arm 285. As shown, the fluid flow paths extend through the satellite portion 280 of the spray arm into the cavity at 410, past the flow director as shown in FIG. 6 and into the spray arm 285 where it courses through the figure-eight channel of the main body 297 of the satellite spray arm 285, and exits the satellite spray arm at nozzles 287.

Conclusion

Embodiments of the present invention provide a variety of advantageous over traditional arrangements. As noted above, it is desirable to maximize the space inside a dishwasher to accommodate a maximum amount of articles to be washed. It is also desirable to include spray arms within the dishwasher to wash and rinse the articles to be rinsed. Thus, minimizing the space occupied by the spray arms while maintaining sufficient spray arm coverage is a challenge. Embodiments provided herein solve this problem by incorporating a highly-efficient spray arm assembly in a compact form factor to maximize the space available for article to be cleaned while also maximizing the spray coverage provided by spray arms.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A spray arm assembly comprising:

a water supply conduit;

a main spray arm rotatably coupled to the water supply conduit, wherein the main spray arm is configured to rotate about a first axis; and a satellite spray arm rotatably coupled to the main spray arm, the satellite spray arm having a neck through which wash fluid enters the satellite spray arm, wherein the satellite spray arm is configured to rotate about a second axis at the neck, the second axis being spaced from the first axis and tilted at an angle with respect to the first axis, wherein to minimize a space occupied by the spray arm assembly:

the satellite spray arm defines at least one nozzle and at least one fluid channel extending in an arcuate shape from a first end at the neck to a second end at the at least one nozzle, the first end is disposed at a first distance relative to a base of the neck, and the second end is disposed a second distance relative to the base of the neck, the first distance and the second distance being parallel to the second axis, and the second distance is shorter than the first distance, such that the at least one fluid channel descends in the arcuate shape from the first end to the second end, and the second distance allowing the second axis to be tilted at the angle while preventing the satellite spray arm from interfering with the water supply conduit.

2. The spray arm assembly of claim 1, wherein the satellite spray arm defines at least two nozzles disposed on opposite sides of the second axis and configured to direct spray away from the main spray arm.

3. The spray arm assembly of claim 2, wherein the at least one channel of the satellite spray arm defines a figure-eight wherein a center of the figure-eight is disposed at the second axis, and the at least two nozzles are disposed on opposite extremities of the figure-eight.

4. The spray arm assembly of claim 1, wherein the second axis is angled relative to the first axis between about two degrees and about eight degrees.

5. The spray arm assembly of claim 1, wherein the second axis is angled relative to the first axis at about four degrees.

6. The spray arm assembly of claim 5, wherein the at least one nozzle is positioned below a fluid inlet to the satellite spray arm during at least a portion of a rotation of the at least one nozzle about the second axis.

7. The spray arm assembly of claim 1, wherein the main spray arm comprises a first portion and a second portion, wherein the first portion is disposed on a first side of the first axis, and the second portion is disposed on a second side of the first axis, opposite the first, characterized in that the first portion of the main spray arm defines a first thickness in the vertical direction, wherein the second portion of the main spray arm defines a second thickness, less than the first thickness, and wherein the satellite spray arm is rotatably coupled to the second portion.

8. The spray arm assembly of claim 1, wherein the main spray arm comprises at least one nozzle configured to direct fluid in a direction that causes rotation of the main spray arm about the first axis, and wherein the satellite spray arm comprises at least one nozzle configured to direct fluid in a direction that causes rotation of the satellite spray arm about the second axis.

9. The spray arm assembly of claim 1, wherein the satellite spray arm comprises an outer ring forming a circle in a plane perpendicular to the second axis.

10. The spray arm assembly of claim 9, wherein the satellite spray arm comprises a main body having a first thickness proximate the second axis, and a second, smaller thickness proximate the outer ring, wherein the thickness tapers from the first thickness to the second thickness.

11. The spray arm assembly of claim 1, wherein the main spray arm comprises a hub into which a neck of the satellite spray arm is received, characterized in that fluid is transmitted from the main spray arm to the satellite spray arm through the hub and the neck.

12. The spray arm assembly of claim 1, wherein the spray arm assembly is suspended from a wash rack of a dishwasher through an attachment between the water supply conduit and the wash rack.

13. The spray arm assembly of claim 1, wherein the satellite spray arm defines a fluid inlet, and wherein each of the at least one nozzles comprises a pair of separate fluid passageways leading from the fluid inlet to the respective nozzle.

14. The spray arm assembly of claim 1, wherein the satellite spray arm comprises an outer ring forming a circle about the second axis, and wherein at least one aperture through the satellite spray arm is defined within the outer ring.

* * * * *